US007204186B2

(12) United States Patent
Mamei et al.

(10) Patent No.: US 7,204,186 B2
(45) Date of Patent: Apr. 17, 2007

(54) FLUID CIRCUIT FOR FEEDING PRIMARY AND AUXILIARY USERS WITH PRESET PRIORITIES

(75) Inventors: Eronne Mamei, Modena (IT); Omer Mamei, Cognento (IT); Enrico Mamei, Modena (IT)

(73) Assignee: Studio Tecnico 6 M S.R.L., Modena (IT)

( * ) Notice: Subject to any disclaimer, the term of this patent is extended or adjusted under 35 U.S.C. 154(b) by 0 days.

(21) Appl. No.: 10/534,875

(22) PCT Filed: Nov. 17, 2003

(86) PCT No.: PCT/IB03/05191

§ 371 (c)(1),
(2), (4) Date: May 12, 2005

(87) PCT Pub. No.: WO2004/046561

PCT Pub. Date: Jun. 3, 2004

(65) Prior Publication Data

US 2005/0284143 A1 Dec. 29, 2005

(30) Foreign Application Priority Data

Nov. 15, 2002 (IT) ..... MO2002A0332

(51) Int. Cl.
*F15B 13/00* (2006.01)

(52) U.S. Cl. ..... 91/516

(58) Field of Classification Search ..... 60/422; 91/516

See application file for complete search history.

(56) References Cited

U.S. PATENT DOCUMENTS

| | | | | |
|---|---|---|---|---|
| 3,971,216 | A * | 7/1976 | Miller | 91/517 |
| 4,556,078 | A * | 12/1985 | Wittren | 91/516 |
| 5,020,324 | A * | 6/1991 | MacDonald et al. | 60/430 |
| 6,176,083 | B1 * | 1/2001 | Ikari | 60/422 |
| 6,460,655 | B2 * | 10/2002 | Miller | 60/430 |
| 6,629,411 | B2 * | 10/2003 | Buscher et al. | 60/425 |
| 2002/0166320 | A1 | 11/2002 | Buscher et al. | |

FOREIGN PATENT DOCUMENTS

| | | |
|---|---|---|
| EP | 1 245 834 A | 10/2002 |
| FR | 2 757 222 A | 6/1998 |

OTHER PUBLICATIONS

International Search Report of PCT/IB03/05191 mailed Mar. 2, 2004.

* cited by examiner

*Primary Examiner*—Michael Leslie
(74) *Attorney, Agent, or Firm*—Nixon & Vanderhye P.C.

(57) ABSTRACT

Fluid-dynamic circuit for supplying primary and auxiliary uses with preset priorities comprises a pressurised fluid source, at least one first use with primary priority, at least one second use with secondary priority, at least one third use with low priority; said first use is directly connected to said source by a relative first pipe and said second use and third use are connectable to said source with respective second and third pipes by interposing a valve equipped with an internal distributor member to control said second and third pipes and movable according to at least three connection configurations, in a first configuration said second use and third use being shut, in a second configuration said second use being open and said third use being shut, in a third configuration said second use being open and said being open.

12 Claims, 2 Drawing Sheets

1
PR1
PR2
EF
30
LS
PR2
LS
PR1
P
40
2
3
4
5
6
7
15
20
20'
100
101
102

1
PR1
PR2
EF
30
LS
PR2
LS
PR1
P
40
2
3
4
5
6
7
15
20
20'
100
101
102

1
PR1
PR2
EF
30
LS
PR2
LS
PR1
40
2
3
4
5
6
7
15
20
20'
100
101
102

FLUID CIRCUIT FOR FEEDING PRIMARY AND AUXILIARY USERS WITH PRESET PRIORITIES

This application is the US national phase of international application PCT/IB2003/005191 filed 17 Nov. 2003, which designated the U.S. and claims priority of IT MO2002A000332, filed 15 Nov. 2002, the entire contents of each of which are hereby incorporated by reference.

This invention concerns a fluid-dynamic circuit for supplying primary and auxiliary uses with preset priorities.

In fluid-dynamic circuits it may be necessary to set so-called "priorities" for supplying different uses with a pumping unit, i.e. setting a desired sequence for supplying of the different uses by the pump may be required.

For example, in operating machines such as agricultural tractors the circuits that supply the different uses, such as the power-assisted steering, the braking system, and a hydraulic lift are equipped with valves suitable for directing volumes of pressurised oil towards said uses according to the priority with which said uses have to be used.

A main priority consists of supplying the hydroguide as it enables the operating machine to be driven in the desired directions.

A secondary, albeit important, priority is considered to be supplying the braking system of the machine and any trailer attached thereto.

Lastly, a final priority is considered to be supplying the different auxiliary services, i.e. the equipment with which the machine is equipped and which enable it to perform the different jobs for which it has been built.

Currently, to obtain the actuation of said supply priorities, circuits are used that tend to consist of a single pump that is connected to a plurality of valves that are in turn serially connected together and interposed between the pump and the different uses to provide them with supplying according to the preset priorities.

Although the serial connection between said valves enables the desired supply sequences to be achieved in a functionally correct manner, it has the disadvantage of generating noticeable losses of load along the supply lines, in particular along the line directed to the auxiliary services.

The technical task of this invention is to eliminate the disadvantages of the prior art mentioned above by devising a fluid-dynamic circuit for supplying primary and auxiliary uses with preset priorities that enables several uses to be supplied with preset priorities, thereby limiting the load losses due to the presence of multiple valve organs.

Another object of this invention is to perform the previous tasks with a fluid-dynamic circuit that has a simple structure and operates effectively, as well as having a relatively moderate cost, the number of valve organs to be used being limited.

This task and these objects are all achieved by this fluid-dynamic circuit for supplying primary and auxiliary uses with preset priorities, comprising a source of pressurised fluid, conventionally indicated by P, at least one first use with primary priority, conventionally indicated by PR1, at least one second use with secondary priority, conventionally indicated by PR2, at least one third use with low priority, conventionally indicated by EF, wherein said PR1 is directly connected to said source P by a relative first pipe, that said PR2 and EF are connectable to said source P with respective second and third pipes by interposing a valve equipped with an internal distributor to control said second and third pipes and movable according to at least three connection configurations, in a first configuration said PR2 and EF being shut, in a second configuration said PR2 being open and said EF being shut, in a third configuration said PR2 being open and said EF being open.

Further characteristics and advantages of the inventions will be made more obvious in the detailed disclosure of a preferred but not exclusive embodiment of a fluid-dynamic circuit for supplying primary and auxiliary uses with preset priorities that is illustrated by way of non-limiting example in the attached drawings wherein.

Figure 3:
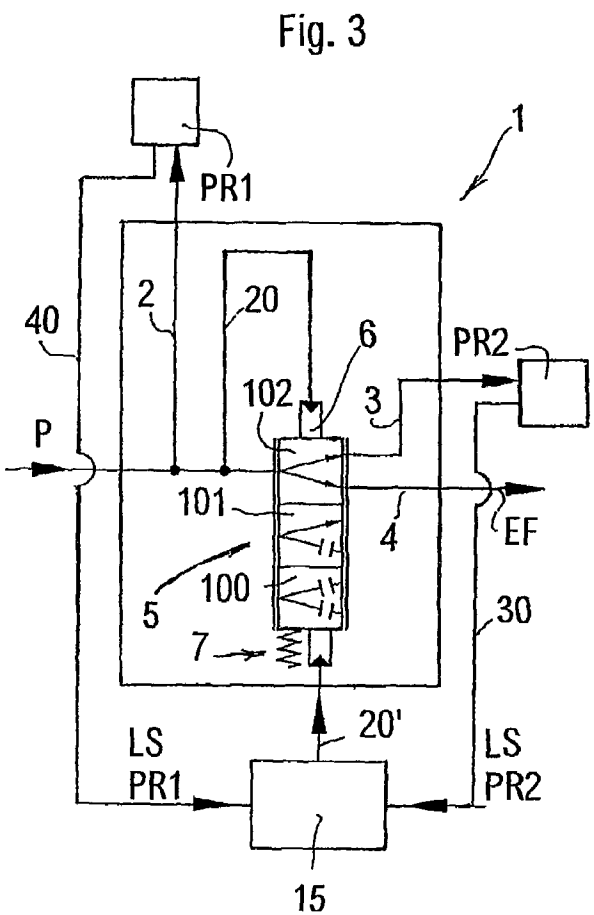
FIGS. 1, 2, 3 show a diagram of a simplified embodiment of a fluid-dynamic circuit for supplying primary and auxiliary services of operating machines with preset priorities, in the three possible connection configurations.

With particular reference to said Figures, 1 indicates overall a fluid-dynamic circuit for supplying primary and auxiliary uses with preset priorities.

The circuit 1 comprises a pressurised fluid source, indicated overall by P, a first use with primary priority, indicated by PR1, a second use with secondary priority, indicated by PR2 and a third use with low priority, indicated by EF.

Said uses are usually connected to the source P by means of the relative pipes: a first pipe 2 connects said use PR1 with primary priority directly to said source P, whilst a second 3 pipe connects the source P to the use PR2 with secondary priority and a third pipe 4 connects the source P to the use EF with low priority.

Said first pipe 2, second pipe 3 and third pipe 4 flow into a valve 5 equipped with an internal distributor member 6 for the control of the connection between said first pipe 2 and second pipe 3 and third pipe 4.

The distributor member 6 is movable according to at least three connection configurations: in a first configuration (FIG. 1), indicated by 100 in the drawings, the uses with secondary priority PR2 and the uses with low priority EF are both shut; in a second configuration (FIG. 2), indicated by 101, the uses secondary priority PR2 and the uses with low priority EF are open and shut respectively; in a third configuration (FIG. 3), indicated by 102, the uses with secondary priority PR2 and the uses with low priority EF are both open.

In the circuit 1 according to the invention, between said source P and the valve 5, a first signal line 20 is provided for detecting the pressure of the fluid and the transmission of the relative signal; also between the uses PR1 and PR2 a third and second signal line for measuring the pressure of said fluid are respectively provided, indicated respectively by 40 and 30; the second and third pressure signal lines 30 and 40 are better known by the technical term "load sensing".

The first signal line 20 emerges on an end of the distributor member 6.

On the opposite end of the distributor member 6 a further signal line 20' emerges that moves away from a selector organ 15 to which the second signal line 30 and the third signal line are connected.

The distributor member 6 is mobile between the three possible configurations 100, 101 and 102 through the action of the pressure differences between said first signal line 20 and the further signal line 20'.

The selector organ 14 is of the conventional type and is used to transfer onto the further signal line 20' the greatest of the pressure signals detected on the second signal line 30 or on the third signal line 40.

The distributor member 6 is also subjected to a continuous contrast action of an elastic element 7 that exerts preset force on the distributor member 6.

The force of the elastic element 7, the pressure of the fluid in the further signal line 20' at one end and the pressure of the fluid in the first signal line 20 at the opposite end therefore act on the distributor member 6.

If there is no pressure in the first signal line 20, and in the further signal line 20', the elastic element 7 shifts the distributor member 6 towards the first configuration 100.

In another embodiment of the circuit 1 shown in FIGS. 4 to 7, the distributor member 6 provides at least a first fourth configuration 103 interposed between the first configuration 100 and the second configuration 101 and a fifth configuration 104 interposed between the second configuration 101 and a fifth configuration 104 interposed between the third configuration 102.

In the fourth configuration 103, the second use PR2 is partially shut in the useful section of the passage of the pressurised fluid and the third use EF is shut.

In the fifth configuration 104, the second use PR2 is open and the third use EF is partially shut.

Normally, the source P comprises a pumping unit that may be of the fixed-flow type, indicated by 8 or of the variable-flow type and indicated by 9.

In the fluid-dynamic circuit 1 according to the invention, between the source P and the first use PR1 at least one protective valve 10 of the use is interposable, said valve 10 being equipped with an organ 11 with a presettable intervention threshold.

The valve 10 is also piloted by a shutter member 12 between at least two intervention positions: in a first position 200 the valve 10 is open and the pressurised fluid flows freely towards the first use PR1 whereas in a second position 201 it is completely shut, thereby interrupting the flow of fluid directed towards said first use PR1.

The organ 11 comprises at least one contrasting spring 13 that continuously acts in the opposite direction to the shift of the shutter member 12 to return it, or to keep it in the normal open configuration 200 of the valve 10.

In a further embodiment of the fluid-dynamic circuit 1, between the source P and the first use PR1, on the pipe branch that connects them a valve 14 is interposable that is suitable for limiting the maximum flow of the fluid directed towards said first use PR1.

Figure 1:
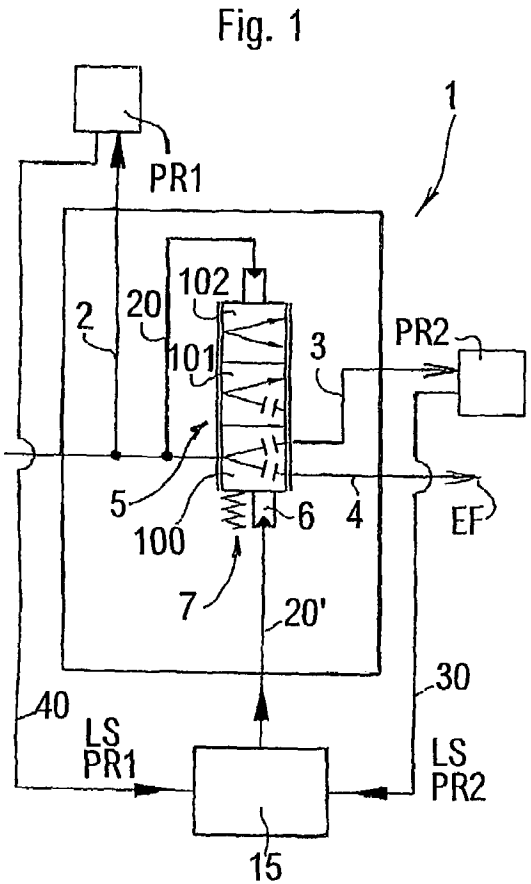
Figure 4:
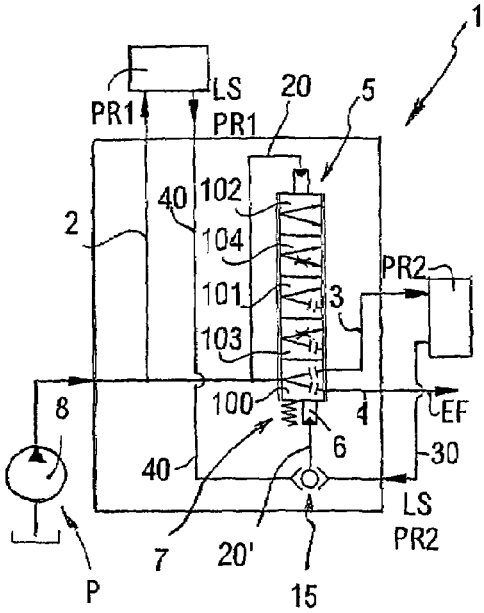
FIGS. 4 and 5 show a diagram of the fluid-dynamic circuit according to the invention in a second possible embodiment with the use of a valve with five operational configurations and respectively with a source of the fixed-flow and variable type.
Figure 5:
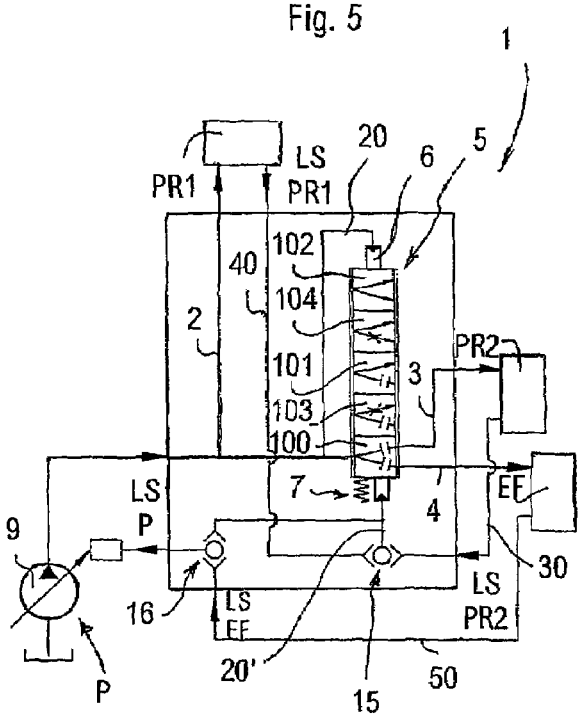
Figure 6:
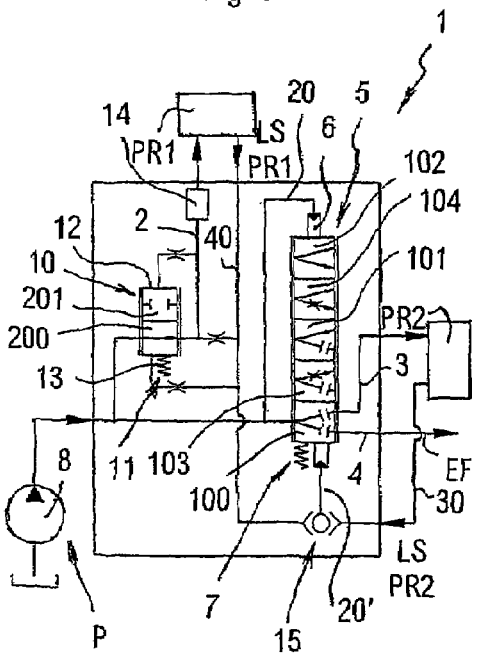
FIGS. 6 and 7 show yet another diagram of the fluid-dynamic circuit according to the invention in a third possible embodiment, equipped with a protective valve interposed between the source and the first use PR1, respectively with said source of the fixed-flow and variable type.
Figure 7:
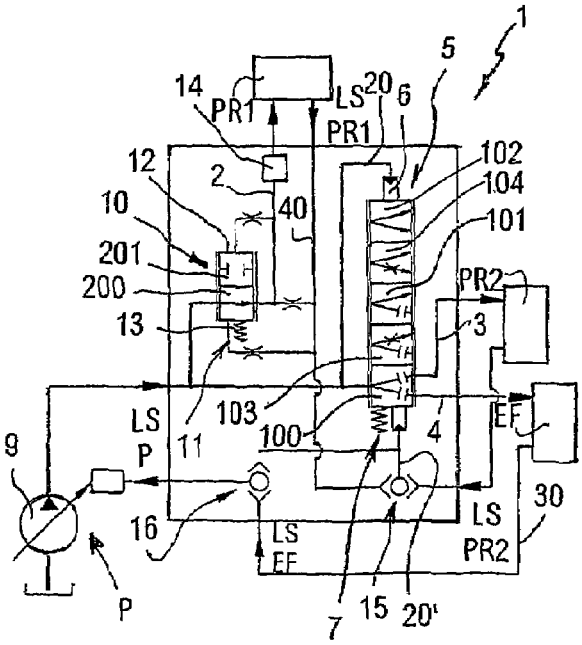

The operation of the fluid-dynamic circuit 1 for supplying primary uses PR1, secondary uses PR2 and auxiliary uses EF with preset priorities according to the invention is as follows: when the first use PR1 requires the entire maximum flow of pressurised fluid, the distributor member 6 of the valve 5, subjected at one end to the diminishing pressure detected by the first signal line 20 and at the opposite end subjected to the pressure detected by the further signal line 20' and to the action of the elastic element 7, it is progressively arranged in the configuration 100 and sequentially closes the connections first with the third use EF and subsequently also with the second use PR2, as indicated in FIG. 1.

When on the other hand the flow of the source P is sufficient to supply all the uses pressures of the first signal line 20 and of the further signal line 20' pilot the distributor member 6 in such a way that the latter is placed in the connection configuration 102 illustrated in FIG. 3, thereby overcoming the contrasting action of the elastic element 7: the pressurised fluid in said configuration suffers rather limited load losses as it has to go through only one valve 5 to reach the different uses, in particular the third use EF.

Figure 2:
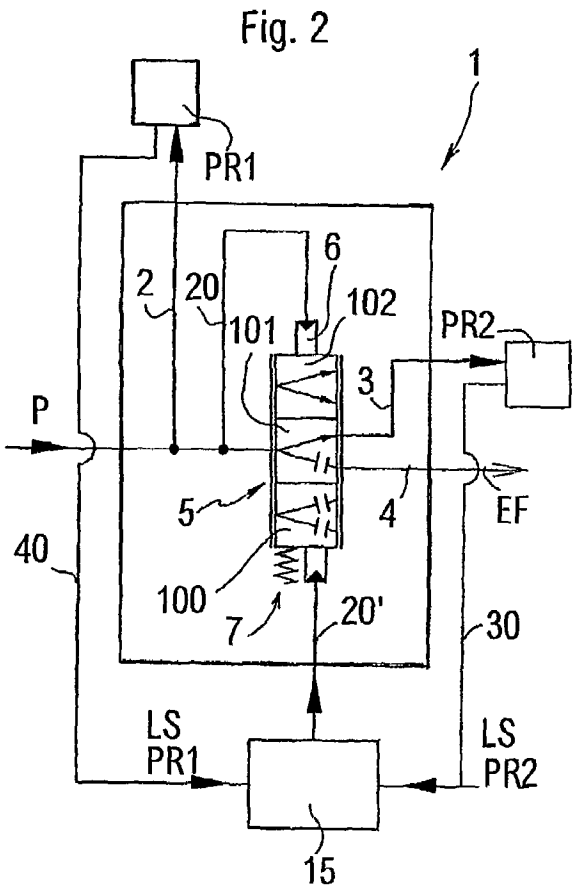

FIG. 2 illustrates an intermediate connection configuration 101, in other words with the distributor member 6 positioned in the configuration 101; in this configuration 101 the supply to the third use EF is shut whilst the supply to the first use PR1 and to the second use PR2 are open; this configuration occurs when the source P has sufficient flow to supply only the first use PR1 and the second use PR2.

For example, if the fluid-dynamic circuit 1 is applied to an operating machine of the type used on construction sites or to a farm tractor the first use PR1 supplies the hydroguide, the second use PR2 supplies the braking system, the third use EF supplies the machine's services, in other words the work tools with which the said machine is equipped.

The operation of the circuit 1 according to the invention is as disclosed above also in the embodiments illustrated in FIGS. 4, 5, 6, 7: the pressures of the second sensor line 30 and of the third sensor line 40 both flow into the selector organ 15 wherefrom the pressure of the further sensor line 20' flows out, which coincides with the greatest pressure of said pressures of the second sensor line 30 and the third sensor line 40.

The pressure of the further sensor line 20' acts on an end of the distributor member 6 and, at the opposite end, there is the action of the first signal line 20.

The distributor member 6, when the operating machine is moving, is in the connection configuration indicated by 102, if the machine is equipped with a source P comprising a pump 9 with variable flow, or in the configuration 104 if the pump 8 is of the fixed-flow type.

When the first use PR1 requires the entire fluid flow, the signal line 20 detects a pressure drop signal; the elastic element 7 acts on the distributor member 6 of the valve 5 and first pushes it and then maintains it in the connection configuration 100 wherein the second use PR2 and the third use EF are both shut.

When the driver acts on the brake, in the pipe 3 of the second use PR2 fluid is recalled: if the flow of the source P is insufficient, the pressure detected by the first signal line 20 is overtaken by the signal of the further signal line 20', which in this case coincides with the pressure of the second signal line 30, added to the force of the elastic element: this progressively shifts the distributor member 6 towards the configuration 101 passing through the fifth configuration 104.

If the source P comprises a pump 9 of the variable-flow type (FIGS. 5 and 7), a fourth pressure-sensor line 50 is provided between the third use EF and the pump 9, also with, the interposing of a second selector organ, indicated by 16, to which are added, in addition to the pressure signal detected by said line 50, also the pressure signal detected by said line 50, also the greatest of the signals detected by the sensor organ 15: the second sensor organ 16 selects and sends to the pump 9 the greatest of said signals to pilot the overall flow of said pump.

Finally, the valve organ 10 can be positioned on the pipe 2, between the source P and the first use PR1 for protection, if requested by the latter in order that it does not reach an excessive non-required flow or pressure that might damage it.

In practice it has been established that the disclosed invention achieves the proposed objects, in particular that it can supply by means of a sole valve at least three uses with preset priorities and with minimal load loss.

The invention that has been thus conceived may be subject to modifications and variations, all of which fall within the scope of protection as defined by the content of the following claims. Furthermore, all the details can be replaced by other technically equivalent details and any materials and shapes and dimensions may be used according to requirements.

The invention claimed is:

1. Fluid-dynamic circuit for supplying primary and auxiliary uses with preset priorities comprising a source of pressurised fluid, at least one first use with primary priority, at least one second use with secondary priority, and at least one third use with low priority, wherein said first use is directly connected to said source by a relative first pipe, said second use and third use are connectable to said source by a second and a third pipe by interposing a valve equipped with a distributor member controlling said second and third pipe and movable according to at least three connection configurations, in a first configuration said second use and third use being shut, in a second configuration said second use being open and third use shut, in a third configuration said second use being open and third use open, and wherein, between said source and said valve, at least one first signal line detecting a first pressure signal of said fluid is provided, between said second use and said valve a second signal line detecting a second pressure signal of said fluid is provided, between said first use and said valve a third signal line detecting a third pressure signal of said fluid is provided.

2. Fluid-dynamic circuit according to claim 1, wherein said first pressure signal line is connected to said distributor member of said valve in an antagonistic manner to said second pressure signal line and said third pressure signal line, said distributor member being actuated mobile between at least three of said connection configurations by signal differences detectable by said first pressure signal line and by said second and third pressure signal lines.

3. Fluid-dynamic circuit according to claim 2, wherein said first pressure signal line activates the shift of said distributor member towards opening connection configurations of said second use and third use, said second and said third pressure signal lines activating the shift of said distributor member towards closing connection configurations of said second use and third use.

4. Fluid-dynamic circuit according to claim 1, wherein at least between said second pressure signal line and said third pressure signal line an organ is interposed selecting said second and third signal, the greatest thereof on the output being selected by a further signal line acting on said distributor member antagonistically in relation to said first signal of said first signal line.

5. Fluid-dynamic circuit according to claims 1, wherein said distributor member is normally contrasted in said second and third connecting configuration by at least one elastic element with a presettable reactive force, to recall said distributor member to said first configuration in the absence of said signals of a first sensor line and of a further sensor line.

6. Fluid-dynamic circuit according to claim 1, wherein said distributor member is positionable in at least a fourth configuration and a fifth configuration, said fourth configuration being interposed between said first configuration and said second configuration, said fifth configuration being interposed between said second configuration and said third configuration, in said fourth configuration said second use being partially shut and said third use being shut, in said fifth configuration said second use being open and said third use being partially shut.

7. Fluid-dynamic circuit according to claim 1, wherein said source comprises a pumping unit of the fixed-flow type.

8. Fluid-dynamic circuit according to claim 1, wherein said source comprises a pumping unit of the variable-flow type.

9. Fluid-dynamic circuit according to claim 1, wherein between said source and said first use at least one protective valve is provided that is equipped with an organ with a presettable intervention threshold.

10. Fluid-dynamic circuit according to claim 9, wherein said at least one protective valve is piloted by a shutter member between at least two intervention positions, said valve being open in a first position, said valve being shut in a second position.

11. Fluid-dynamic circuit according to claim 10, wherein said organ with a presettable intervention threshold comprises at least one pre-chargeable contrast spring constantly acting on said shutter member to recall the latter to said open configuration of said at least one protective valve.

12. Fluid-dynamic circuit according to claim 1, wherein between said source and said first use a valve limiting the flow of fluid towards said first use is provided.

* * * * *